US006083033A

United States Patent [19]

Yamamoto et al.

[11] Patent Number: 6,083,033

[45] Date of Patent: Jul. 4, 2000

[54] ELECTRICAL CONNECTOR HAVING TERMINAL DISTORTION PREVENTING STRUCTURE

[75] Inventors: Hiroshi Yamamoto, Shizuoka; Takahiro Yoneda, Kanagawa, both of Japan

[73] Assignees: Yazaki Corporation, Tokyo; Nissan Motor Co., Ltd., Kanagawa, both of Japan

[21] Appl. No.: 09/226,186

[22] Filed: Jan. 7, 1999

[30] Foreign Application Priority Data

Jan. 9, 1998 [JP] Japan ..... 10-003282

[51] Int. Cl.[7] ..... H01R 13/64

[52] U.S. Cl. ..... 439/381

[58] Field of Search ..... 439/374, 380, 439/381, 682

[56] References Cited

U.S. PATENT DOCUMENTS

| | | | |
|---|---|---|---|
| 3,646,500 | 2/1972 | Wessely | 439/381 |
| 3,800,268 | 3/1974 | Bruckner et al. | 439/381 |
| 5,494,453 | 2/1996 | Tsuji et al. | 439/381 |
| 5,803,771 | 9/1998 | Knapp | 439/381 |
| 5,890,932 | 4/1999 | Muta | 439/682 |

FOREIGN PATENT DOCUMENTS

| | | |
|---|---|---|
| 61-117470 | 7/1986 | Japan . |
| 5-53146 | 7/1993 | Japan . |
| 9-45401 | 8/1997 | Japan . |

*Primary Examiner*—Gary F. Paumen

*Attorney, Agent, or Firm*—Armstrong, Westerman, Hattori, McLeland & Naughton

[57] ABSTRACT

The connector includes at least a terminal accommodating cavity for receiving a receptacle terminal of a rectangular hollow beam shape. The receptacle terminal has an electrical connection portion including a resilient contact tongue. The terminal accommodating cavity has a pin terminal insertion opening. Furthermore, a pair of distortion preventing members opposed to one another and projecting respectively from each of opposed inner side walls of the terminal accommodating cavity are provided adjacent to the pin terminal insertion opening. A guide recess is defined in each side wall of the electrical contact portion for guiding the distortion preventing member. The distortion preventing members are able to prevent distortion of the pin terminal cooperatively with an inner surface of a pin terminal insertion opening even when the pin terminal is incorrectly inserted in a slanting direction through the pin terminal insertion opening into the receptacle terminal.

5 Claims, 7 Drawing Sheets

ELECTRICAL CONNECTOR HAVING TERMINAL DISTORTION PREVENTING STRUCTURE

BACKGROUND OF THE INVENTION

1. Field of the Invention

The present invention relates to an electrical connector, more particularly to a connector having a distortion preventing structure for preventing deformation of both a pin terminal and a resilient contact tongue of a receptacle terminal mounted in the connector when the pin terminal is inserted into the receptacle terminal to make contact with the resilient contact tongue.

2. Prior Art

There has been proposed a receptacle terminal having a distortion preventing structure in Japanese Utility Model Application Laid-open No. 61-117,470, which is shown in FIG. 9. The distortion preventing structure includes a protection/guide piece 62 and a resilient pinching inner strip 63 (FIG. 10). The guide piece 62 is formed continuously from a fore end portion of a rectangular hollow beam shaped, electrical connection portion 61 that composes the receptacle terminal.

The receptacle terminal 60 is received in a connector housing 64 of a connector 66 and a pin terminal 65 is received in an opposed connector housing (not shown) of an associated opposed connector (not shown). Engagement of the connector 66 with the associated connector connects electrically the resilient pinching strip 63 of the receptacle terminal 60 to the pin terminal 65. Even when the associated connector is opposed to the connector 66 incorrectly in a slating direction during their mating, the guide piece 62 of the receptacle terminal 60 can correct the insertion direction of the pin terminal 65.

However, the receptacle terminal 60 has a complicated configuration which requires an increased manufacturing cost. Furthermore, a smaller receptacle terminal 60 provides a thinner guide piece 62 that is reduced in strength. The pin terminal 65 may deform the thinner guide piece 62 when the connector 66 is engaged with the associated connector incorrectly in a slanting direction so that the pin terminal 65 is forcedly inserted into the receptacle terminal 60. This possibly causes the pin terminal 65 to abut against the resilient pinching strip 63 to undesirably distort (or deform) the resilient pinching strip 63.

Furthermore, there has been also proposed another receptacle terminal having a distortion preventing structure in Japanese Utility Model Application Laid-open No. H. 5-53, 146, which is shown in FIG. 11.

The distortion preventing structure includes a pair of extending tabs 72 and an inner resilient contact tongue 73 (FIG. 12). Each extending tab 72 is formed continuously from a fore end portion of an electrical connection portion 71 that composes the receptacle terminal 70. The extending tab 72 covers a lower half of the fore end opening of the receptacle terminal 70. Engagement of a connector 74 accommodating the receptacle terminal 70 with an opposed associated connector (not shown) connects electrically the resilient contact tongue 73 of the receptacle terminal 70 to the pin terminal 75.

Even when the associated connector is opposed to the connector 74 incorrectly in a slanting direction during their mating, the extending tabs 72 of the receptacle terminal 70 can correct the insertion direction of the pin terminal 75.

However, the extending tabs 72 can correct the insertion direction of the pin terminal 75 that has been inserted into the receptacle terminal 70 in a slanting direction only when the slanting angle is within a small range. That is, the correctable initial insertion angle of the pin terminal 75 is limited in a small range because the extending tab 72 has a small thickness s that is usually the same as that of the receptacle terminal 70.

SUMMARY OF THE INVENTION

In view of the above-mentioned problem, an object of the present invention is to provide a connector having a terminal distortion preventing structure for preventing deformation of a resilient contact tongue provided in a receptacle terminal of the connector even when a pin terminal is inserted into the receptacle terminal incorrectly in a slanting direction of which a larger slanting angle is allowable. In addition, the receptacle terminal can have a more simplified construction.

To achieve the object, a connector according to a first basic configuration of the present invention includes:

a connector housing, at least a terminal accommodating cavity defined in the connector housing for receiving a receptacle terminal of a rectangular hollow beam shape, the receptacle terminal having an electrical connection portion including a resilient contact tongue, a pin terminal insertion opening defined in the connector housing, a distortion preventing member projecting from each of opposed inner side walls of the terminal accommodating cavity, the distortion preventing member being adjacent to the pin terminal insertion opening, and a guide recess defined in each side wall of the electrical contact portion for guiding the distortion preventing member, wherein the distortion preventing member is able to prevent distortion of the pin terminal cooperatively with an inner surface of the pin terminal insertion opening even when the pin terminal is incorrectly inserted in a slanting direction through the pin terminal insertion opening into the receptacle terminal.

According to a second additional configuration of the present invention, the distortion preventing member has a pair of opposed projecting portions each laterally projecting from each side wall of the terminal accommodating cavity and an extended portion extending from each the projecting portion, the extended portion extending inwardly within the terminal accommodating cavity in parallel with the insertion direction of the pin terminal, whereby the pin terminal is corrected in its insertion direction by the extended portion of the distortion preventing member when the pin terminal is inserted incorrectly into the receptacle terminal in a slanting direction.

According to a third additional configuration of the present invention, the pair of projecting portions are connected to one another.

Operation and effects of the present invention will be discussed hereinafter.

As described above, in the first configuration of the invention, the distortion preventing member projects from the pair of opposed inner side walls of the terminal accommodating cavity of the connector housing, the distortion preventing member being adjacent to the pin terminal insertion opening, and the guide recess is defined in each side wall of the electrical contact portion for guiding distortion preventing member. Thereby, the pin terminal sidably abuts both against the distortion preventing member and against an inner surface of the pin terminal insertion opening even when the pin terminal is incorrectly inserted in a slanting direction through the pin terminal insertion opening into the receptacle terminal. This prevents the slanting pin terminal from directly abutting against the resilient contact tongue, preventing an undesirable deformation of the resilient contact tongue. In addition, the pin terminal is also prevented from an undesirable distortion. Moreover, a simplified receptacle terminal having a resilient contact tongue could be applied to the connector, and the distortion preventing structure is comparatively small in manufacturing cost.

In the second configuration of the invention, the distortion preventing member has the pair of opposed projecting portions each laterally projecting from each side wall of the terminal accommodating cavity and an extended portion extending from each the projecting portion, the extended portion extending inwardly within the terminal accommodating cavity in parallel with the insertion direction of the pin terminal. Thus, the pin terminal slidably abuts against the extended portion when the pin terminal is inserted incorrectly into the receptacle terminal in a slanting direction. Then, the pin terminal is corrected to be substantially in parallel with the longitudinal direction of the receptacle terminal before making contact with the resilient contact tongue. In addition, the extended portion having a longer length provides a larger allowable range in the initial slanting angle of the pin terminal.

In the third configuration of the invention, the pair of the laterally projecting portions have been connected to one another. This structure is preferable for surely preventing distortion of the pin terminal and for correcting the pin terminal in its insertion direction.

DETAILED DESCRIPTION OF PREFERRED EMBODIMENTS

Referring to the accompanied drawings, an embodiment of the present invention will be discussed hereinafter.

FIGS. 1 to 6 show an embodiment that is a connector having a terminal distortion preventing structure.

Figure 1:
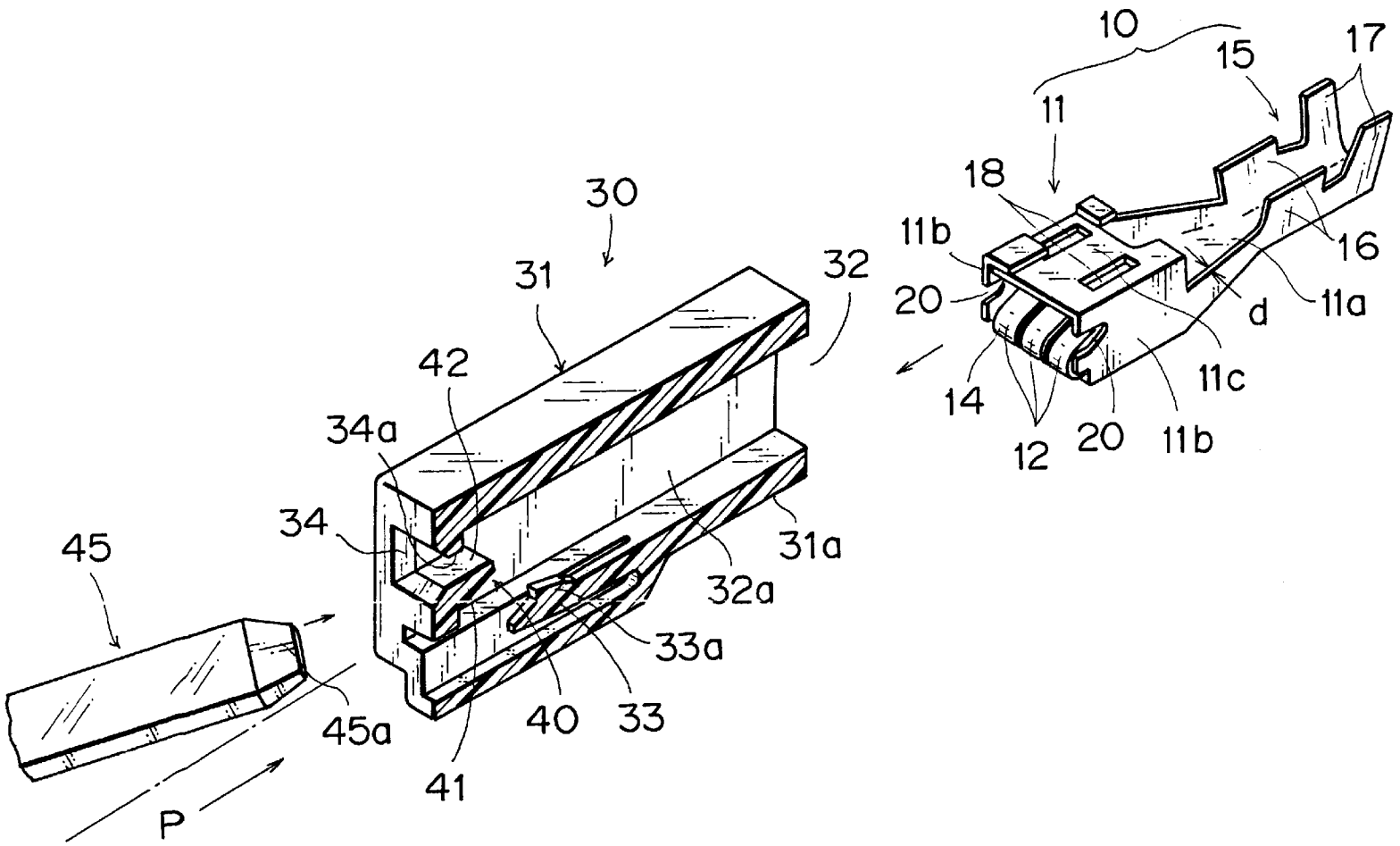
FIG. 1 is a perspective overview showing an embodiment of a connector having terminal distortion preventing structure according to the present invention.

In FIG. 1, the connector includes a receptacle terminal 10 having an electrical contact portion 11 that has a pair of side walls 11*b*, 11*b* between which a resilient contact tongue 12 is provided. Each side wall 11*b* is formed with a guide recess 20. The connector has a connector housing 30 formed with a terminal accommodating cavity 32 for receiving the receptacle terminal 10. The terminal accommodating cavity 32 has a pair of side walls 32*a*, 32*a*, each of which is provided with a terminal distortion preventing member 40.

The receptacle terminal 10 has an electrical connection portion 11 of a rectangular hollow beam shape at one end side of a base plate 11*a* thereof and an electrical cable connection portion 15 at the other end side of the base plate 11*a*. The electrical connection portion 11 has a pair of side walls 11*b*, 11*b* each rising from each side end of the base plate 11*a*, a top wall 11*c* across the pair of side wall 11*b*, 11*b*, and the resilient contact tongue 12 extending from a fore end portion of the base plate 11*a* within the electrical connection portion 15. The base plate 11*a* has a lock hole 13 (FIG. 5) for locking the resilient contact tongue 12. A pin terminal 45 is inserted from an end opening 14 of the electrical contact portion 11 to be electrically connected to the resilient contact tongue 12.

Figure 2:
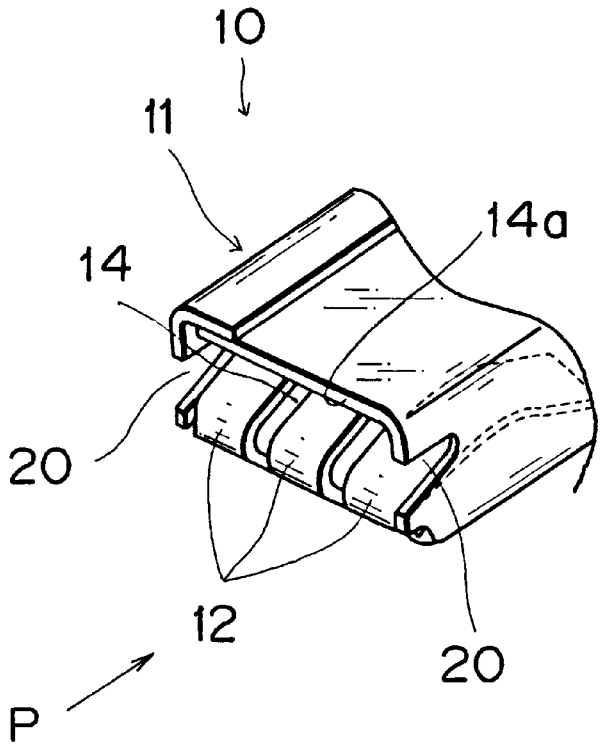
FIG. 2 is a perspective, partial enlarged view of a receptacle terminal of FIG. 1.
Figure 3:
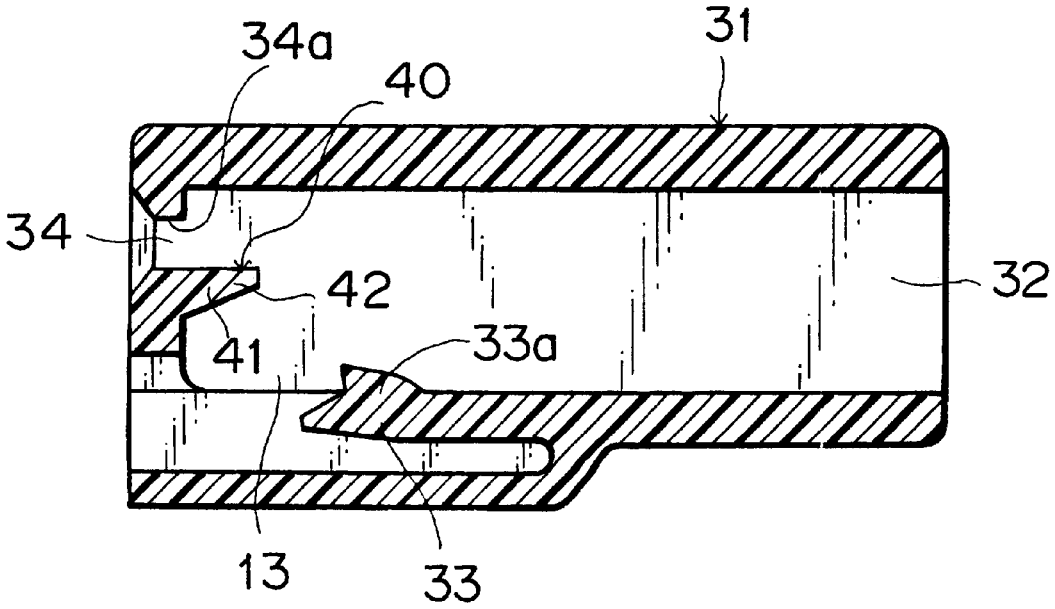
FIG. 3 is a sectional view showing a connector housing of FIG. 1.
Figure 4:
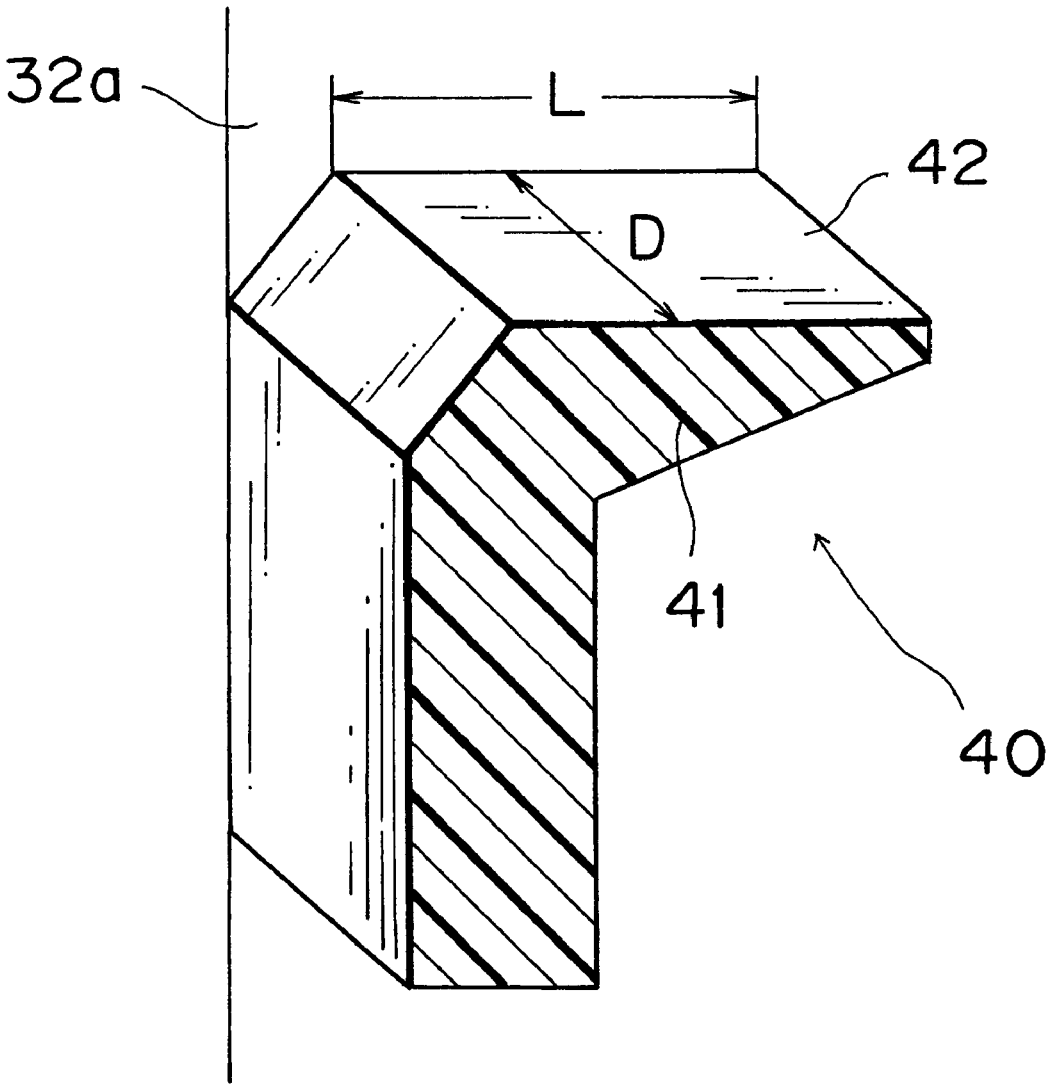
FIG. 4 is a perspective enlarged view showing a distortion preventing member of FIG. 1.
Figure 5:
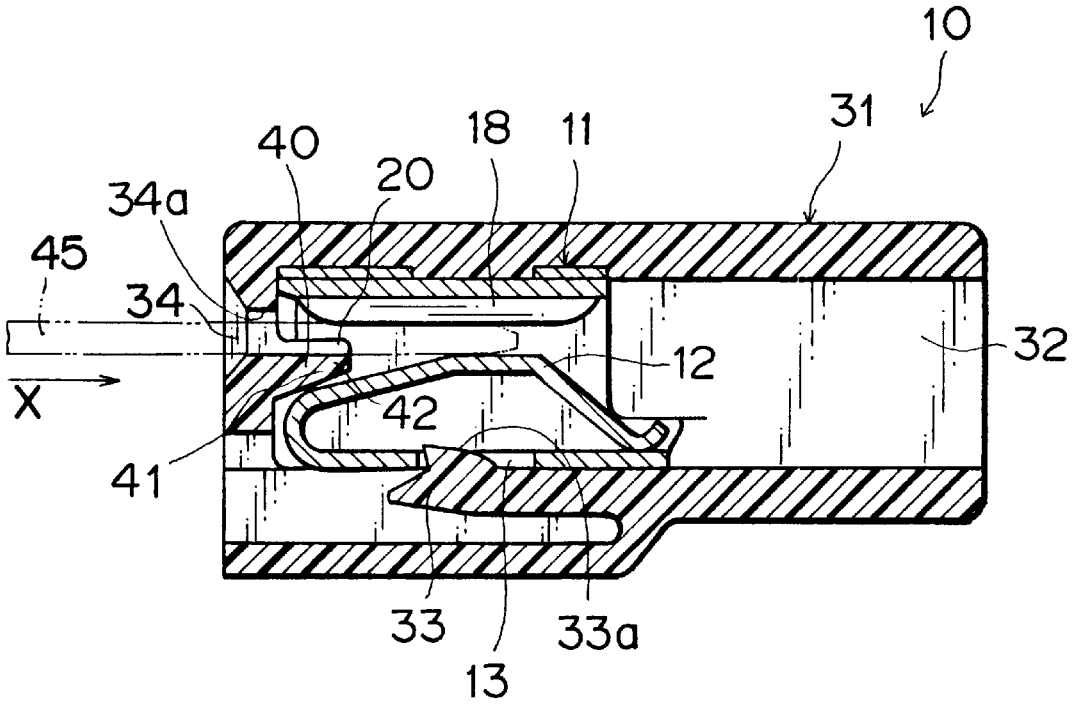
FIG. 5 is a longitudinal sectional view showing the connector housing which has received the receptacle terminal.

As shown in FIG. 2, each side wall 11*b* of the electrical contact portion 11 is formed with a guide recess 20 extending from an open end 14*a* of the electrical contact portion 11 substantially in parallel with the insertion direction P of the pin terminal 45. In this embodiment, the guide recess 20, as shown in FIG. 5, is arranged along the resilient contact tongue 12 and may be modified in shape to be positioned within a region above the resilient contact tongue 12.

Referring again to FIG. 1, the electrical connection portion 15 has both a pair of stripped cable crimping pieces 16 and a pair of insulated cable crimping pieces 17, each of which rises from each side end of the base plate 11*a* in the rear side of the electrical connection portion 15. The crimping pieces 16 usually crimp a stripped cable (not shown) while the crimping pieces 17 crimp an insulated cable (not shown) for electrically connecting the cable to the electrical connection portion 15.

The connector housing 30 has a main housing body 31 formed with the terminal accommodating cavity 32 for receiving the receptacle terminal 10. In the housing body 31, there is provided a resilient lock arm 33 extending from a bottom wall 31*a*. The resilient lock arm 33 has a lock protrusion 33*a* that engages with the lock hole 13 (FIG. 5) of the receptacle terminal 10. The connector housing 30 has a pin terminal insertion opening 34 continuously adjacent to the terminal accommodating cavity 32 for receiving a pin terminal 45.

Figure 7:
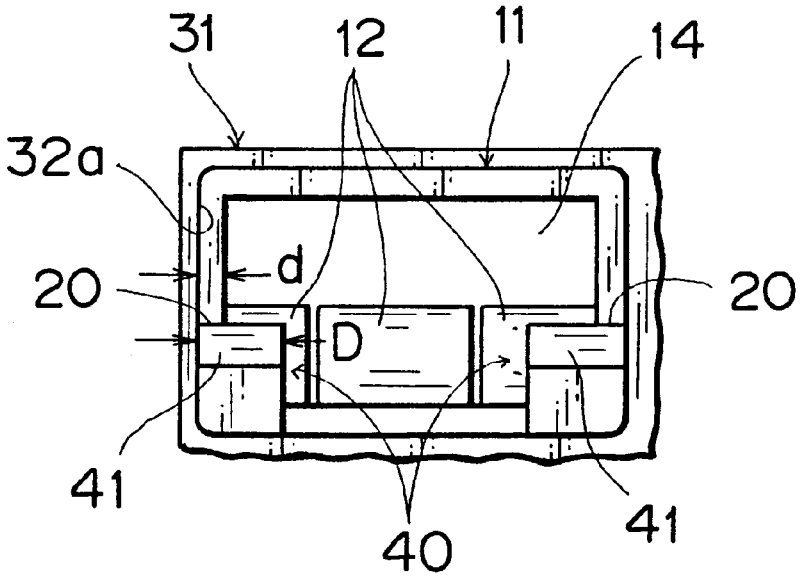
FIG. 7 is a view taken in the direction of an arrow X of FIG. 5 (the pin terminal is not illustrated)

The terminal accommodating cavity 32 is formed with a distortion preventing member 40 in each side wall 32*a* thereof. The distortion preventing member 40 includes both a projecting portion 41 laterally projecting from one of the side walls 32*a* of the terminal accommodating cavity 32 and an extended portion 42 extending from the projecting portion 41 in parallel with the insertion direction P of the pin terminal 45. As shown in FIG. 7, the extended portion 42 has a width D (also see FIG. 4) that is larger than a plate thickness d (FIG. 1) of the receptacle terminal 10 (D>d). The extended portion 42 has a desired length, in which, as shown in FIG. 5, both the projecting portion 41 and the extended portion 42 do not interfere with the resilient contact tongue 12 when the receptacle terminal 10 is set in the terminal accommodating cavity 32.

Figure 8:
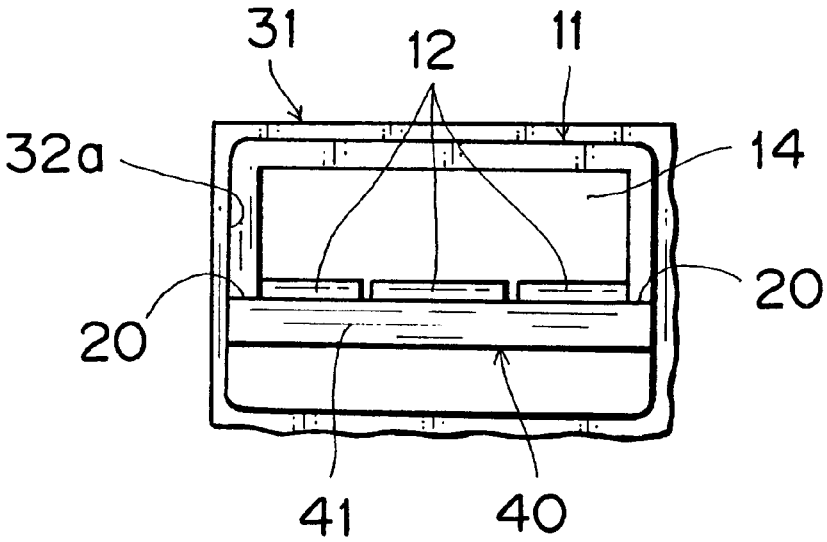
FIG. 8 is a view taken in the direction of the arrow X of FIG. 5, which is different from FIG. 7 in that a pair of laterally projecting portions of the distortion preventing member are connected to one another.
Figure 9:
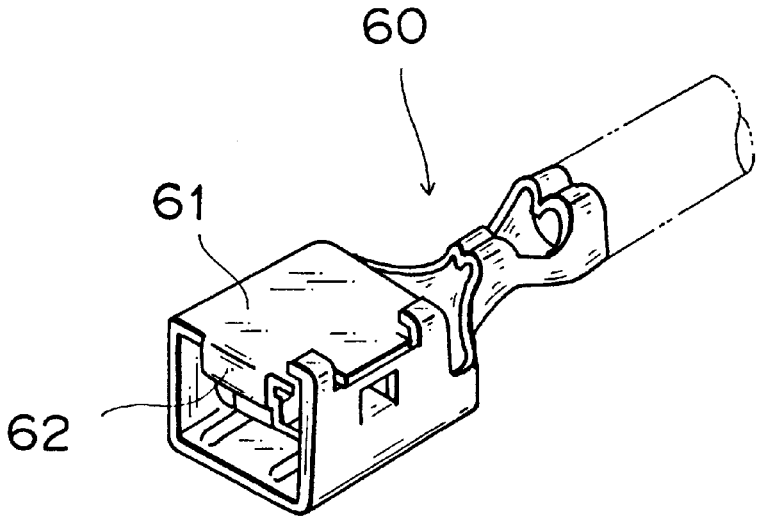
FIG. 9 PRIOR ART
FIG. 9 is a perspective view showing a conventional receptacle terminal.
Figure 10:
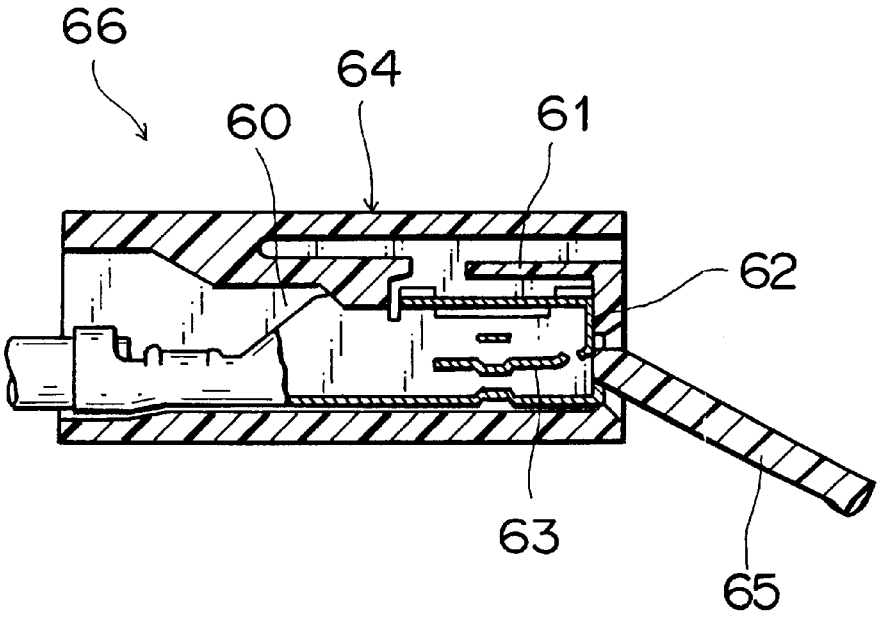
FIG. 10 PRIOR ART
FIG. 10 is an explanatory longitudinal sectional view showing a connector housing that has received the conventional receptacle terminal of FIG. 9, in which a pin terminal is inserted initially incorrectly in a slanting direction.
Figure 11:
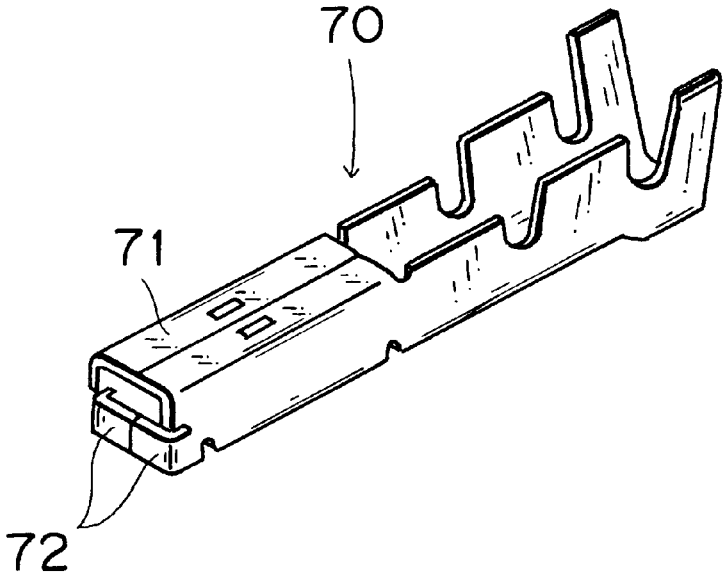
FIG. 11 PRIOR ART
FIG. 11 is a perspective view showing another conventional receptacle terminal.
Figure 12:
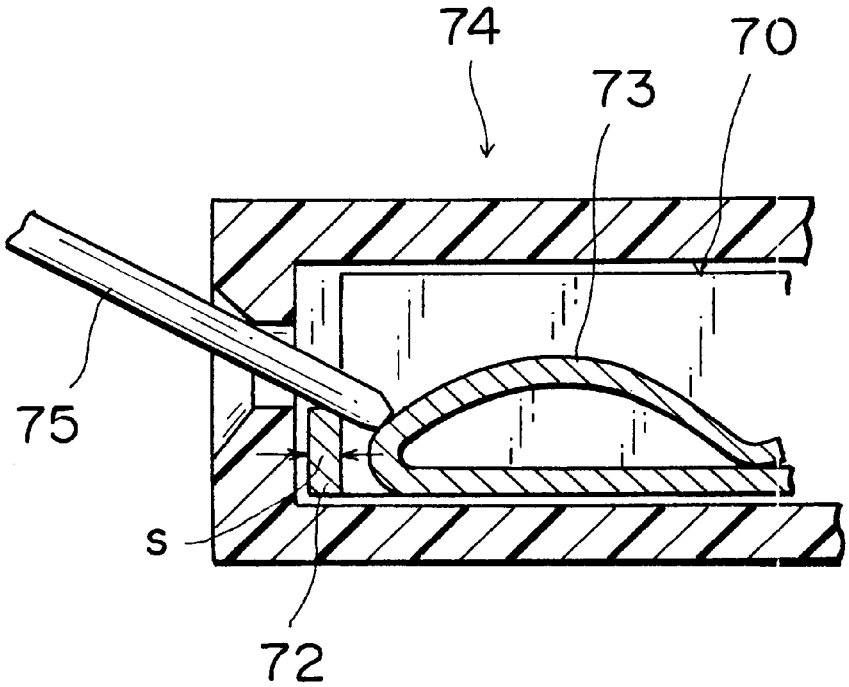
FIG. 12 PRIOR ART
FIG. 12 is an explanatory longitudinal sectional view showing a connector housing that has received the another conventional receptacle terminal of FIG. 11, in which a pin terminal is inserted initially incorrectly in a slanting direction.

When the terminal accommodating cavity 32 has received the receptacle terminal 10, the extended portion 42 of the distortion preventing member 40 is partially received in the electrical contact portion 11 of the receptacle terminal 10 above the resilient contact tongue 12. In addition, as shown in FIG. 8, the left and right distortion preventing members 40 may be connected to one another so that the laterally projecting portions 41, 41 are formed in one body across the left and right side walls 32*a*, 32*a*. Alternatively, the pair of the laterally projecting portions 41, 41 may be arranged to be offset from one another in the direction P.

Next, an insertion step of the pin terminal 45 into the receptacle terminal 10 that has been received in the connector housing 30 will be discussed hereinafter. The terminal 10 is a pin terminal inserted into a second connector housing (not shown), or a tab-shaped terminal applied in a busbar (not shown) arranged in an electrical junction box (not shown).

Figure 6:
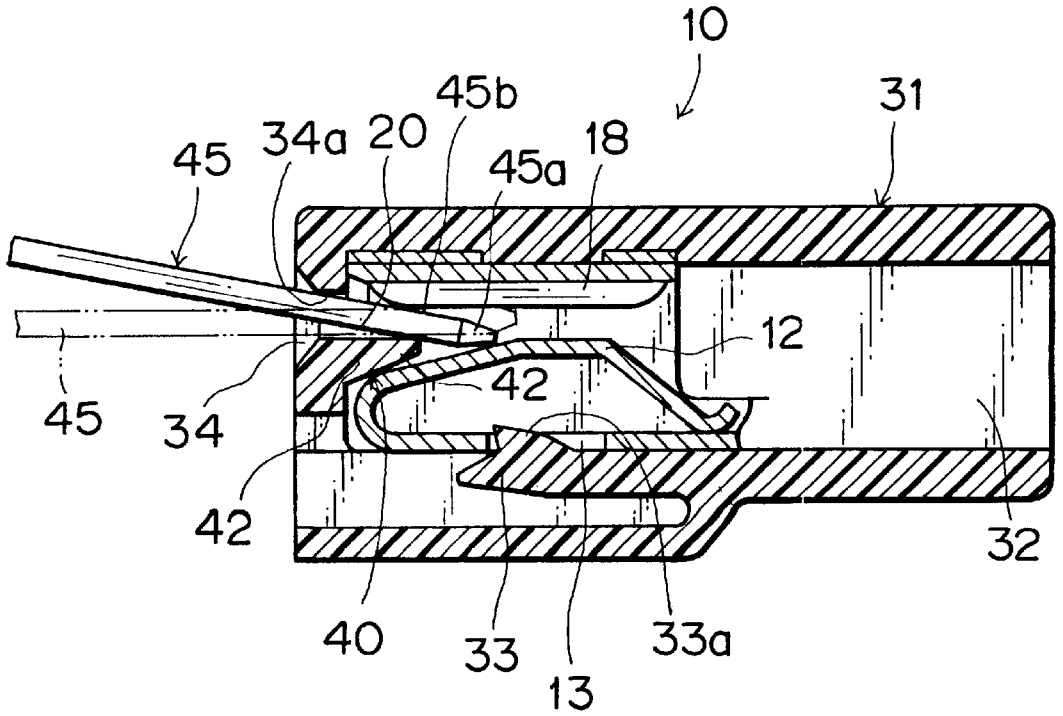
FIG. 6 is an explanatory longitudinal sectional view showing the connector housing that has received the receptacle terminal, in which a pin terminal is inserted initially incorrectly in a slanting direction.

As shown in FIG. 5, the receptacle terminal 10 is inserted into the connector housing 30 so that the distortion preventing member 40 positioned in the terminal accommodating cavity 32 is partially received in the guide recess 20 of the receptacle terminal 10, and the extended portion 42 of the distortion preventing member 40 advances into the electrical contact portion 11. As shown in FIG. 6, when the pin terminal 45 is inserted from the pin terminal insertion opening 34 into the receptacle terminal 10 incorrectly in a slating direction, the leading end 45*a* of the pin terminal 45 abuts slidably against the extended wall 42 of the distortion preventing member 40 and against an opening edge 34*a* of the pin terminal insertion opening 34.

A further advancement of the pin terminal 45 into the receptacle terminal 10 for electrically connecting the pin terminal 45 to the receptacle terminal 10 corrects the pin terminal 45 to be substantially parallel with the longitudinal direction of the receptacle terminal 10 by the extended portion 42. Thus, the pin terminal 45 is smoothly inserted into the electrical contact portion 11 of the receptacle terminal 10, allowing the pin terminal 45 to make electrical contact with the resilient contact tongue 12 of the receptacle terminal 10.

In addition, a raised contact 18 may be preferably defined by inwardly pushing out a part of the top wall 11*c* of the electrical contact portion 11. The raised contact 18 is useful for correcting the pin terminal 45 in its advancing direction as well as the opening edge 34*a* of the pin terminal insertion opening 34, because a middle part 45*b* of the pin terminal 45 slidably abuts against a round fore end of the raised contact 18 when the pin terminal 45 is inserted into the receptacle terminal 10 in a slanting direction. Thereby, the pin terminal 45 which is inserted into the receptacle terminal 10 in such a slanting direction is corrected more surely to be substantially parallel with the receptacle terminal 10.

Hence, the leading end 45*a* of the slanting pin terminal 45 is prevented from directly abutting against the resilient contact tongue 12 so that the resilient contact tongue 12 may not deform undesirably. Furthermore, the receptacle terminal 10 having the guide recess 20 can be easily molded. As a whole, the receptacle terminal 10 is more simplified in shape than the conventional ones described in the prior art, improving the manufacturing cost of the receptacle terminal.

Moreover, even if both the receptacle terminal 10 and the connector housing 30 are smaller in size, it will be prevented that the leading end 45*a* of the pin terminal 45 causes an undesirable deformation of the resilient contact tongue 12, as far as the receptacle terminal 10 and the connector housing 30 having the distortion preventing member 40 are rigidly formed. In addition, the pin terminal 45 does not contact the resilient contact tongue 12 when the leading end 45*a* of the pin terminal 45 has not advanced into the electrical contact portion 11 of the receptacle terminal 10 more than the length L (FIG. 4) of the extended portion 42.

That is, the resilient contact tongue 12 of the receptacle terminal 10 mounted in the terminal accommodating cavity 32 can make contact with the pin terminal 45 at the back of the extended portion 42 of the length L within the receptacle terminal 10. According to the overall length of the pin terminal 45, the length L of the extended wall 42 will be preferably modified. This eliminates the modification of the receptacle terminal 10 or the connector housing 30 in size according to the overall length of the pin terminal 45. As a result, the receptacle terminal 10 or the connector housing 30 will be reduced in manufacturing cost.

What is claimed is:

1. An electrical connector comprising:

a connector housing, at least a terminal accommodating cavity defined in said connector housing for receiving a receptacle terminal of a rectangular hollow beam shape, the receptacle terminal having an electrical connection portion including a resilient contact tongue, a pin terminal insertion opening defined in said connector housing, a distortion preventing member projecting from each of opposed inner side walls of said terminal accommodating cavity, said distortion preventing member being adjacent to said pin terminal insertion opening, and a guide recess defined in each side wall of said electrical contact portion for receiving therein said distortion preventing member, wherein said distortion preventing member is able to prevent distortion of said pin terminal cooperatively with an inner surface of said pin terminal insertion opening even when said pin terminal is incorrectly inserted in a slanting direction through said pin terminal insertion opening into said receptacle terminal.

2. The connector recited in claim 1, wherein said distortion preventing member has a pair of opposed projecting portions each laterally projecting from each side wall of said terminal accommodating cavity and an extended portion extending from each said projecting portion, said extended portion extending inwardly within said terminal accommodating cavity in parallel with the insertion direction of said pin terminal, whereby said pin terminal is corrected in its insertion direction by said extended portion of said distortion preventing member when said pin terminal is inserted incorrectly into said receptacle terminal in a slanting direction.

3. The connector recited in claim 2, wherein said pair of projecting portions are connected to one another.

4. The connector recited in claim 2, wherein said extended portion of said projecting portion is constructed in such a way that said pin terminal can make contact with said resilient contact tongue only in a region of said connector housing which is longitudinally inward from said extended wall in said connector housing.

5. The connector recited in claim 1, wherein said receptacle terminal has at least a raised contact defined by partially pushing out a top wall of said receptacle terminal, said raised contact having an elongated length extending in a longitudinal direction of said receptacle terminal.

* * * * *